US006202566B1

(12) United States Patent
Hutchinson

(10) Patent No.: US 6,202,566 B1
(45) Date of Patent: Mar. 20, 2001

(54) HIGH-SPEED HIGH-CAPACITY TRANSPORTATION SYSTEM

(76) Inventor: Larry Hutchinson, 6950 SW. Juniper Ter., Beaverton, OR (US) 97008

( * ) Notice: Subject to any disclaimer, the term of this patent is extended or adjusted under 35 U.S.C. 154(b) by 0 days.

(21) Appl. No.: 09/368,047

(22) Filed: Aug. 3, 1999

(51) Int. Cl.[7] ..... B61B 3/00

(52) U.S. Cl. ..... 105/148; 104/89; 104/93; 104/96; 104/124; 104/126; 104/118; 105/150; 105/154; 105/199.2

(58) Field of Search ..... 104/96, 104, 105, 104/130.07, 93, 94, 95; 105/148, 149, 150, 152, 154, 155, 199.2

(56) References Cited

U.S. PATENT DOCUMENTS

| | | | | |
|---|---|---|---|---|
| 3,118,392 | | 1/1964 | Zimmerman . | |
| 3,702,590 | | 11/1972 | Corey | 104/105 |
| 3,829,175 | | 8/1974 | Vogeli | 308/6 R |
| 3,841,224 | | 10/1974 | Hejj et al. | 104/105 |
| 3,861,315 | | 1/1975 | Rypinski . | |
| 4,172,423 | | 10/1979 | Monne | 104/94 |
| 4,203,369 | | 5/1980 | Perrott | 104/130 |
| 4,214,535 | | 7/1980 | Gerhard . | |
| 4,287,830 | * | 9/1981 | Braun et al. | 104/247 |
| 4,576,096 | | 3/1986 | Toder | 104/94 |
| 4,841,871 | * | 6/1989 | Leibowitz | 104/23.1 |
| 5,060,575 | | 10/1991 | Hallett . | |
| 5,074,220 | * | 12/1991 | Petersen | 104/93 |
| 5,653,174 | | 8/1997 | Halus . | |
| 5,925,080 | * | 7/1999 | Shimbara et al. | 701/23 |

FOREIGN PATENT DOCUMENTS

| | | | |
|---|---|---|---|
| 121132 | 3/1962 | (FR) | 105/155 |

* cited by examiner

*Primary Examiner*—S. Joseph Morano
*Assistant Examiner*—Frantz F. Jules

(57) ABSTRACT

A high-speed high-capacity transportation system is composed of an elevated inverted U-shaped electrified guideway that provides traction and capture surfaces for wheeled motive modules that ride within. Payloads are suspended below the motive unit using a narrow flange. Motive units use flat wheels which ride on flat surfaces of the guideway. The wheels and electric power pickups constitute the only mechanical contact between the vehicle and guideway. Sensors on the motive unit provide position information to an electronic control subsystem which directs the steering of the motive units wheels so as to maintain the desired path through the guideway. As an option, one or more auxiliary wheels can be brought into contact with running surfaces located at the top of the inverted U for additional traction and stability. The payload unit is connected to a the motive unit by way of a hinge that allows the payload to swing laterally. A DC gear motor can be used to provide damping and can also be used to purposely tip the motive unit when passing through a junction. The invention uses a passive Y-shaped section to split or join streams of vehicles. In a Y-section the primary wheels of the motive unit drive over a slot through which the payload-holding flange may pass. Vehicles can exit or merge with minimal vehicle spacing and at full speed. An important application of the system is the use of vehicle carrier payloads that can transport unmodified surface vehicles.

31 Claims, 6 Drawing Sheets

HIGH-SPEED HIGH-CAPACITY TRANSPORTATION SYSTEM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates in general to the field of transportation and more particularly to overhead guideway systems in which a payload is suspended from a motive unit traveling within the guideway channel and employing steerable wheels combined with electronic sensors and control for laterally positioning the motive unit within the channel.

2. Brief Description of the Prior Art

Transportation is one of the greatest problems in the world today. Traffic accidents kill 40,000 people each year in the USA alone and many more are severely injured. Many people waste several hours per day stuck in traffic that is constantly getting more and more congested. Automobiles are a major source of air pollution and consume prodigious amounts of fossil fuel. Roadways use vast amounts of valuable land while land for new roads is often impossible to come by, especially in urban areas where new roads are needed the most.

Over the years, attempts have been made to wean people from their cars onto mass transit systems such as light rail and bus systems. These have been ineffectual in reducing pollution and congestion in metropolitan areas. In spite of claims to the contrary by proponents, light rail systems have a capacity that is only a fraction of that of a freeway and yet are outrageously expensive in terms of cost per passenger served. They also suffer from the "can't get there from here" syndrome; most people have to use their automobiles to get from their homes to a train stop and then use buses to get anywhere near their destination.

Mass transit systems are inherently inefficient. They require the entire vehicle and all of its passengers to constantly start and stop to service just a few passengers per stop. They also force people into a schedule that is not their own and often require multiple transfers sometimes under unpleasant weather conditions. They also subject passengers to conditions of overcrowding and discomfort.

Those who push for mass transit fail to recognize the fact that people like their cars. They like the privacy, mobility, freedom and the personal nature of private automobiles and are willing to put up with the concomitant congestion and frustration. The private automobile and road system, for all its problems, actually works well because people are able, at a moment's notice, to drive in as much comfort and style as they can afford directly to any place they desire. Until such time as a transportation system is in effect that provides direct door-to-door service, people will continue to use their own cars and no amount of lecturing and cajoling will change this situation. Rather than trying to force people into a situation they do not want, we need to provide a solution to the simple problem of getting from point A to point B that takes into account the desire of people for privacy and personalized service.

Our current surface transportation system evolved over thousands of years starting with simple footpaths and is now quite sophisticated. However, all transportation systems based on surface roads or railways suffer from a number of basic flaws. They all use vast amounts of valuable land area that is often very hard to come by especially when additional capacity needs to be added in a metropolitan area. They are often paralyzed by snow and ice and are made dangerous by rain. They interfere with and endanger other surface traffic including pedestrians and bicycles. Surface street intersections cause vehicles to engage in a very inefficient pattern of stopping and starting. Cloverleaf interchanges allow continuous motion but require massive structures taking up an inordinate amount of land and can be used only rarely. It is time for a fresh approach to transportation that takes us off the surface road paradigm; one that can be the starting point for a brand-new evolution.

Any new approach must take into consideration the real requirements of an ideal transportation system and must not be just a Band-Aid solution that attempts to fix the symptoms rather than address the underlying issues.

An ideal transportation system should transport individuals in complete safety directly to their destination at a moment's notice and with minimal wasted time. It should combine high speed with vast capacity and immunity from congestion. It should minimize pollution and the use of fossil fuel while being quiet, convenient and enjoyable to use. It should minimize land use, should not interfere with pedestrians or other surface traffic and should not be an eyesore. It must be capable of operating under extreme weather conditions including ice, snow, fog, high winds, and drenching rain and must be designed to minimize loss of life in case of earthquake, landslide, tornadoes and even terrorist activity. It must be affordable and be capable of being implemented piece-wise while augmenting systems currently in use. It must not require huge investments in infrastructure before it can be used. It should not require that individuals own special vehicles but should encourage the use of electric cars.

Here are more details for selected issues:

Safety

The high level of accidents and of congestion on roadways stems from the fact that each vehicle is piloted by an individual human being with varying skill, mood and attention level. An ideal system will use automation and will not depend on the skill of humans for safety. Already, the National Automated Highway System Consortium has demonstrated computerized driving of specially equipped automobiles on a specially prepared California highway. However, the uncontrolled nature of surface roads along with the need for special vehicles poses major obstacles to a practical implementation of this experiment.

Time

An important measure of the quality of a transportation system is its ability to minimize the total transit time of an individual user. The total time includes both the time in transit and the time waiting to enter or exit the system. Time spent in the system where the user is able to comfortably read or perform work does not count as negatively as time where the user is jostled, cramped or is occupied with driving. Psychologically, time spent waiting for a vehicle to arrive counts much greater than time spent in the vehicle.

Capacity

The capacity of a ground transportation system depends on the number of lanes and the speed and spacing between vehicles at the most restricted choke point. Choke points include entrance and exit ramps and stations and interchanges. It does little good to have high-speed close spaced travel if vehicles have to either slow down or be widely spaced to enter or exit the travelway.

Pollution

The pollution emitted by today's automobiles stems from the fact that each vehicle has to carry its own energy supply. The only practical energy source that has the required capacity involves the burning of fossil fuel. Even if 100% clean fossil fuel burning automobiles were to be developed, they would still emit copious quantities of the greenhouse gas, carbon dioxide. Breakthroughs in completely non-polluting energy supplies have been right around the corner for the past 50 years and will probably continue to be right around the corner for the next 50 years. An ideal system would power vehicles directly from the travelway, eliminating the need for a massive on-board energy supply.

Congestion

Congestion is perhaps the greatest problem with the roadway system today, especially in the mind of the commuting public. People generally disregard safety and pollution issues but congestion causes daily frustration. The principal cause of congestion is demand exceeding capacity and is exacerbated by the individual driving habits of the public such as excessive and unwise lane changes, inappropriate speed and improper spacing.

Many transportation systems have been devised to replace or augment the current highway system. Prior attempts have all been either outrageously expensive or have contained a fatal design flaw that rendered them impractical. All have failed to properly address the above requirements for an ideal system. One of the most common pitfalls is the chicken and egg syndrome where expensive travelways must be built and each individual must own a special vehicle. No one would want to buy an expensive special vehicle without travelways and communities will not provide funding for expensive travelways if no one can use them.

Raised or overhead transportation systems have an advantage over our surface-based highway system in that they allow the ground under the travelway to be left natural or to be used for other purposes. They also eliminate interactions with pedestrians and other ground based traffic and allow free passage of wildlife in remote areas. The advantages of a raised monorail system have been known for a long time. The German Wuppertal monorail, which uses a passenger compartment that is suspended from the rail, has been in operation since 1901 and now carries around 50,000 passengers per day.

Overhead systems in which the payload rides above the track are top heavy and need massive (and thus expensive) guideways. Systems in which the payload is suspended from the guideway are inherently stable and can use much lighter and less expensive tracks.

There are several patents that recognize the advantage of an overhead guideway with suspended payload units.

Zimmerman, U.S. Pat. No. 3,118,392 proposes a system in which payload modules are suspended from motor modules which ride in an overhead inverted U shaped monorail track. Switching between tracks is accomplished by moving portions of the traction surface within junction sections.

Rypinski, U.S. Pat. No. 3,861,315 discloses a dual-mode transportation system in which a surface mode vehicle is transported with the aid of a motor module riding in an inverted U shaped overhead track.

Leibowitz, U.S. Pat. No. 4,841,871 discloses a raised monorail system that utilizes suspended passenger vehicles with aerodynamic lift while Halus, U.S. Pat. No. 5,653,174 discloses an aircraft that is powered and guided by a linear electromagnetic cable.

Petersen, U.S. Pat. No. 5,074,220 proposes an overhead monorail system in which payload cabins hang from a motorized carriage that rides inside an enclosed tube-like travelway. The carriage uses in-line wheels riding in a concave lower surface along with a guide wheel that travels in an upper concave surface. The payload is supported from the carriage by a flange that extends through a slot in the guideway. Although vehicles may turn onto a secondary guideway without any active components in the guideway, the turn mechanism utilizes guide rollers that contact cam surfaces on the sides of the guideway.

The following patents disclose switching mechanisms for suspended monorail systems.

Gerhard, U.S. Pat. No. 4,214,535 discloses a switch for a suspended railway vehicle with elastic wheels in which one wheel runs unsupported in a gap between pairs of rails while in the switch section. Ramps are used to compensate for compression of the wheel material. The scheme uses rollers that engage guiding surfaces in the sidewalls of the structure.

Hallett et al., U.S. Pat. No. 5,060,575 disclose a turn controller for a suspended track mounted vehicle. The system uses wide wheels that drive over the slot through which the payload hangs. However, guide rollers on the vehicle make contact with a guide vane on the track structure.

None of the above systems is capable of high-speed close-spaced travel. Many use cams or other mechanical contact between the vehicle and guideway for positioning and steering (especially in Y-junctions and the like.) Some use rounded wheels and rounded traction surfaces resulting in high levels of friction, wear and noise.

Accordingly, it is an object of this invention to provide an overhead transportation system that can operate at very high speeds with minimal contact between vehicle and guideway.

Another object of this invention is to provide a transportation system that can operate with minimal spacing between vehicles at full speed even when merging two vehicle streams into one or when splitting one stream into two.

A further object of this invention is to provide a transportation system that is mechanically simple with an inexpensive minimal sized guideway that utilizes no moving parts.

Yet another object of this invention is to provide a transportation system that can operate with a much higher degree of safety than a highway and in an energy-efficient and pollution free manner.

Still another object of this invention is to provide a transportation system that can transport people in the vehicles they already own, effectively converting fossil fuel vehicles into electric vehicles for the time they are on the system.

Other objects and advantages will become apparent from time to time throughout the specification and claims as hereinafter related.

BRIEF SUMMARY OF THE INVENTION

The above noted objects and advantages of the invention are accomplished by a transportation system composed of an elevated inverted U-shaped guideway that carries an electric power conductor and provides traction and capture surfaces for wheeled motive modules that ride within the guideway. Payloads (passenger, freight and vehicle carriers) are suspended below the motive unit using a narrow flange medially located under the motive unit. The motive unit is generally much smaller than the payload unit. The guideway is very simple and is completely passive with no moving parts.

The motive units use large wheels sized for high-speed travel and, along with electric power pickups, represent the only mechanical contact between the vehicle and guideway. The wheels ride on the flat surfaces of inward facing flanges at the bottom of the inverted U. Sensors on the motive unit provide position information to an electronic control subsystem which utilizes that information to direct the steering of the motive units wheels so as to maintain the desired path through the guideway. While the steering system prevents contact between the sides of the motive unit and the sides of the guideway, the configuration provides fail safe mechanical containment in the event of loss of control.

As an option, one or more auxiliary wheels can be brought into contact with a running surface or surfaces located at or near the top of the inverted U. This can be used to provide additional traction or to counteract pitching forces at high speed or during emergency deceleration.

The payload unit is connected to the flange below the motive unit by way of a hinge that allows the payload to swing left and right. This hinge allows g forces in a curve to remain normal to the passengers providing a more pleasant ride. It also prevents the motive unit from tipping in a curve or in a side wind. A damping unit is attached to the hinge for greater passenger comfort. An electric motor can optionally be used to create the damping forces and can also be used to purposely tip the motive unit to remove downward force from one side or the other while passing through a junction section of guideway.

The invention uses a passive Y-shaped diverge/merge section to split one stream of vehicles into two or to join two into one. In such a section, the lower traction surfaces are extended inward until they nearly touch forming a narrow slot through which the payload support flange must pass. The flange does not contact the edges of the slot, being precisely guided by the electronic steering. The primary wheels of the motive unit are wide enough to drive over the slot without losing contact with the traction surfaces. The passive nature allows vehicles to take an exit even though the spacing between vehicles is nearly zero. Similarly, when a vehicle merges into a stream, it is necessary only to provide a gap slightly larger than the vehicle itself.

An important application of the system is the use of vehicle carrier payloads that can transport unmodified surface vehicles. This allows the system to transport people in their own vehicles without requiring that individuals purchase new vehicles or make modifications to their existing cars. The system promotes the use of electric cars because it eliminates the need for long range batteries. Because everyone can immediately utilize the system, it can start out small, for example as a tollway augmenting a congested freeway, but can be expanded to eventually create a network as extensive as the current roadway system. Once the system is significantly interconnected, passenger modules can be added allowing people to leave their cars behind if desired.

The concluding portion of this specification particularly points out and distinctly claims the subject matter of the present invention. However those skilled in the art will best understand both the organization and method of operation of the invention, together with further advantages and objects thereof, by reading the remaining portions of the specification in view of the accompanying drawings wherein like reference characters refer to like elements.

DETAILED DESCRIPTION OF THE INVENTION

Figure 1:
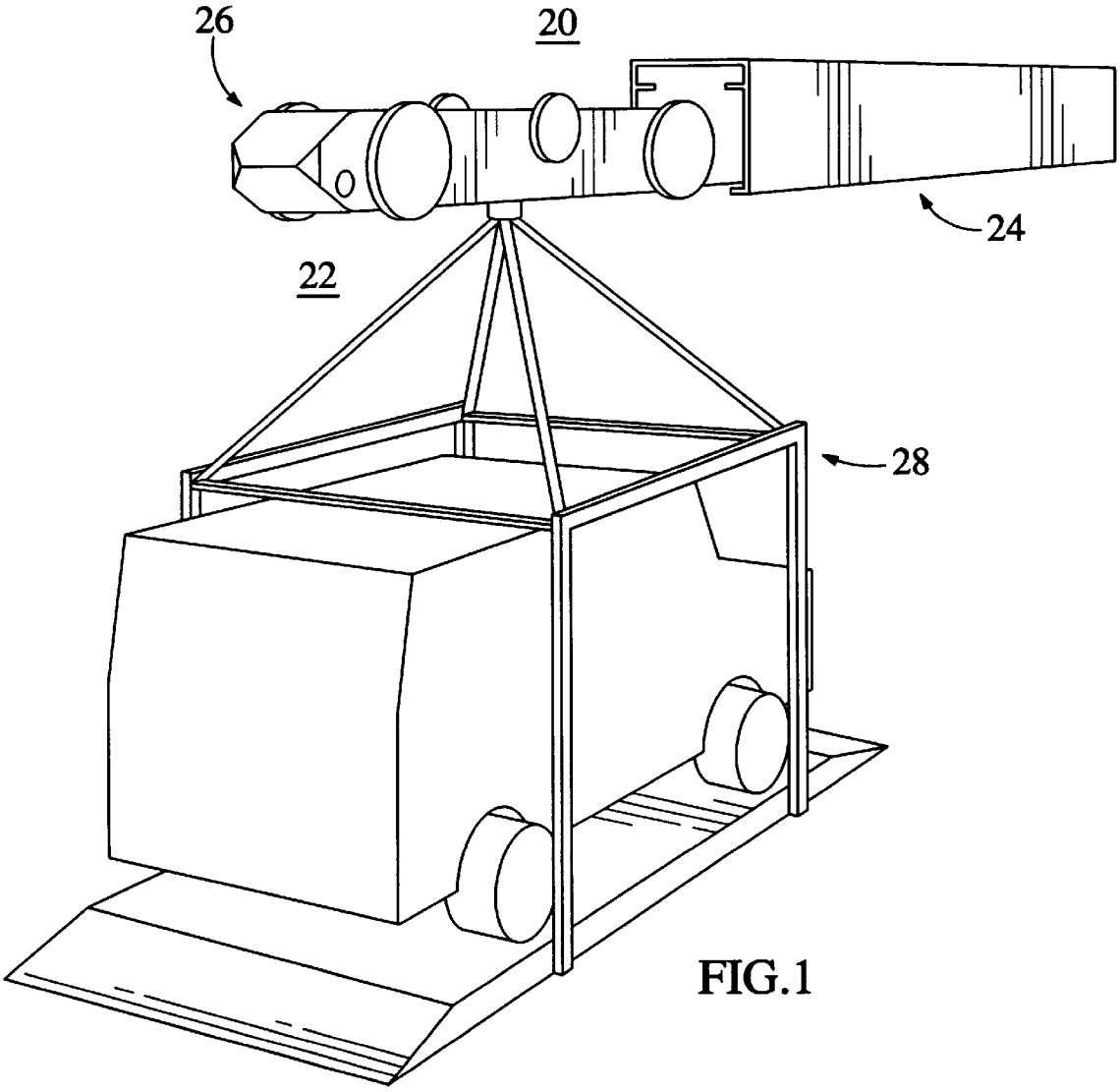
FIG. 1 is a perspective overview of the system.

FIG. 1 illustrates a typical implementation of the transportation system 20. The two principal components are the transport module 22 and an elongate overhead guideway 24 which extends in a horizontal longitudinal direction and acts as a pathway for a motive unit 26. Transport module 22 is composed of motive unit 26 which supports a payload unit 28. Motive unit 26 rides within guideway 24 using steerable wheels combined with proximity sensors and electronic control to keep the unit along the desired path and to avoid contact with the sides of the guideway. Precise electronic steering allows motive unit 26 to navigate at high speed through a complex network of straight or curving guideway sections interconnected by Y-shaped diverge/merge sections 82 (see FIG. 11).

Depending on the desired application, a variety of payload configurations may be used. The payload unit depicted in FIG. 1 is of a type that can carry an automobile or other surface road vehicle. This configuration is important because it allows even short stretches of track to be practical, ferrying traffic around congested highway sections. As the track network grows beyond the initial simple configuration, it becomes practical to add passenger carriers to the system. Later, freight modules can be added with track spurs serving individual businesses. Eventually, when the network is as extensive as our current road system, track spurs could serve individual homes or groups of homes.

A smaller scale system (perhaps a third of the scale evident in FIG. 1) with passenger carrying payload units could be used in an urban setting as a Personal Rapid Transit network. Such a network could increase usage of mass transit systems by eliminating the need for passengers to use buses to get from a station to their destination.

Figure 2:
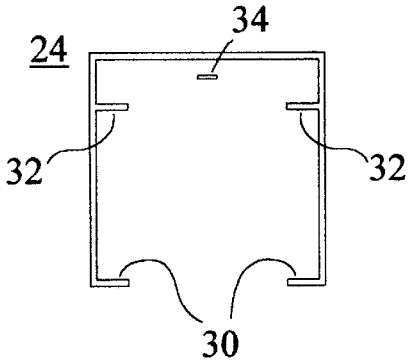
FIG. 2 is a cross section of a guideway.
Figure 3:
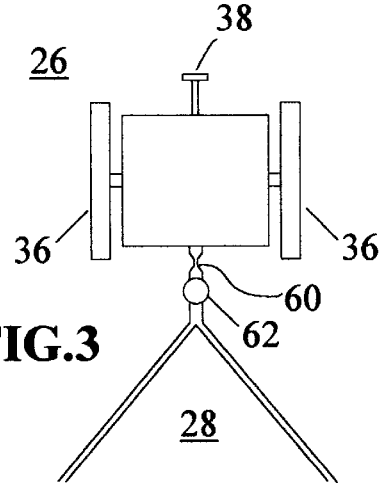
FIG. 3 is a front elevation view of a motive unit.
Figure 4:
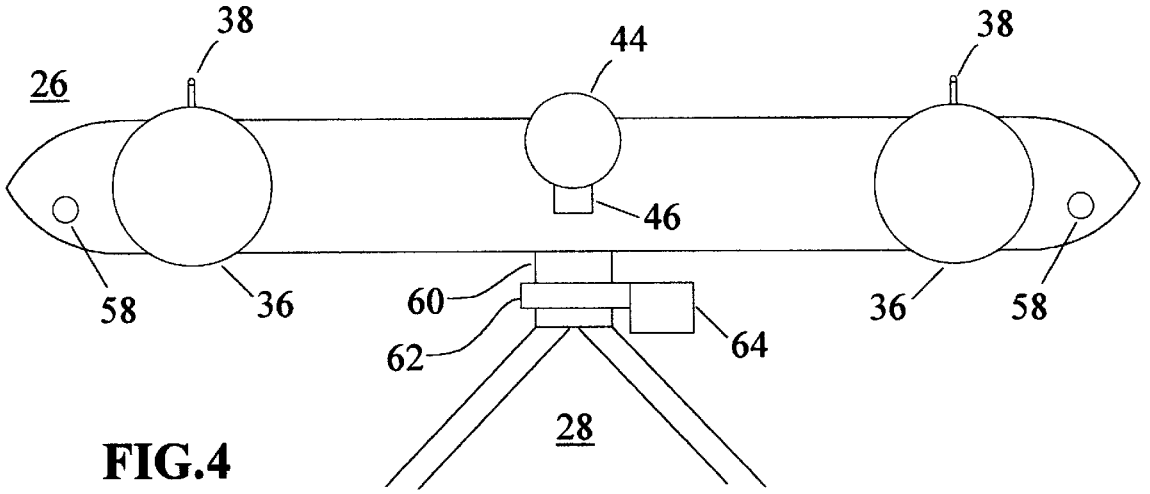
FIG. 4 is a side elevation view of a motive unit.

FIG. 2 shows a cross section of guideway 24 while FIG. 3 shows motive unit 26 from the same perspective and FIG. 4 provides a side elevation view of motive unit 26. Guideway 24 has an inverted U shape with inward facing flanges at the bottom of the U which form primary traction surfaces 30. An additional pair of inward facing flanges is located near the top of guideway 24 and form secondary traction surfaces 32. The top of primary traction surface 30 and the bottom of secondary traction surface 32 are substantially flat and smooth. Suspended below the top of guideway 24 but above secondary traction surfaces 32 is power conductor 34. Because power conductor 34 is near the stiff structure of the guideway channel, it can be precisely and rigidly positioned. This allows the power pickup arrangement on motive unit 26 to be much simpler than the pantographs used for light rail and electric buses. For example, the under surface of the power conductor could be flat and wide enabling the use of a wheel type power pickup. Motive unit 26 is supported and driven by two pairs of primary wheels 36 which ride on primary traction surfaces 30. The contact surfaces of primary wheels 36 are flat to match the flat profile of primary traction surfaces 30. Under nominal operating conditions, the only contact between motive unit 26 and guideway 24 is at the bottom of primary wheels 36 and at electric pickup points 38. Contact between the top of primary wheels 36 and secondary traction surfaces 32 or between primary wheels 36 and the side walls of guideway 24 would occur only under emergency conditions.

Figure 5:
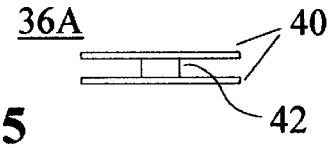
FIG. 5 is a plan view of a split wheel assembly.

The system as depicted uses narrow wheels in order to minimize turning friction and noise. Since the wheels have to ride over a slot through which a payload-holding flange must pass (described below), the slot and the flange must be quite narrow. The size of the slot and the flange can be increased while still keeping turning friction and noise to a minimum by replacing each primary wheel 36 with a split wheel 36A composed of a pair of spaced apart subwheel assemblies 40. As shown in FIG. 5, a clutch mechanism 42 connects the two subwheel assemblies 40. Clutch 42 allows slippage between the two halves when going around a curve.

Both the primary traction surfaces 30 and the primary wheels 36 may be made of metal to provide an electrical current return path for power conductor 34. In the alternative, return power conductors may be placed along the sides of guideway 24 with wheel or sliding contact points provided on both sides of motive unit 26.

The particular embodiment of motive unit 26 illustrated in FIG. 4 includes a pair of stabilizing wheels 44 which may be forced into contact with secondary traction surfaces 32 as needed to provide additional traction or resistance to tipping by increasing the force between primary wheels 36 and primary traction surfaces 30. Stabilizing wheels 44 need not be powered although it may be desirable to use a very small motor to ensure the wheel is rotating at track speed before contact in order to reduce noise. Each stabilizing wheel 44 may be independently raised or lowered using actuator 46. Any suitable technology such as hydraulic, pneumatic or electo-mechanical may be used for the actuator. In many applications, it will be desirable to adjust the force applied by the actuator.

Figure 6:
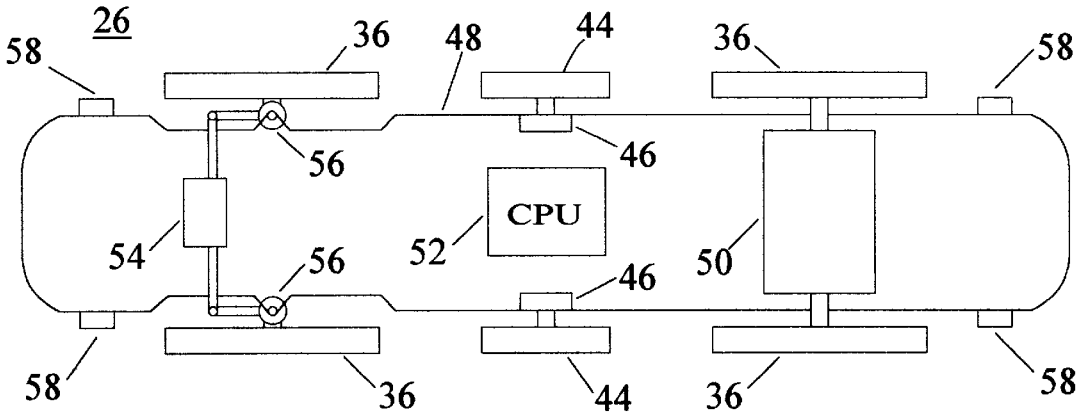
FIG. 6 is a schematic diagram of a motive unit.

FIG. 6 shows a top view of motive unit 26 with various components shown in schematic form. Motive unit 26 comprises chassis 48 upon which are mounted one or more electric motors 50 for powering the motion of the vehicle via primary wheels 36, one or more computer units 52 for controlling all aspects of the vehicle, and steering actuators 54 for adjusting the angular position of the steerable primary wheels 36 about vertical axis pivots 56. Proximity sensors 58 monitor the lateral position of motive unit 26 within guideway 24. Actuators 46 adjust the vertical position and force of stabilizing wheels 44 relative to secondary traction surfaces 32.

For clarity, FIG. 6 omits a number of other conventional components that are expected to be present in motive unit 26. For example, a battery may be needed to provide control and steering power in the event the main power source via power conductor 34 is interrupted. A power converter will be needed to accept electrical power from electric pickup points 38 and to distribute power to electric motor 50 and other parts of the system. One or more wireless communications modules will be needed to allow vehicles to communicate with one another and with fixed stations. Radar modules with beams directed along the guideway channel in both forward and rear directions may be used to detect obstruction.

Although FIG. 6 shows two primary wheels 36 that are steerable and two that are driven by electric motor 50, it is expected that most four primary wheel motive units will be designed with four wheel steering and four wheel power.

Figure 7:
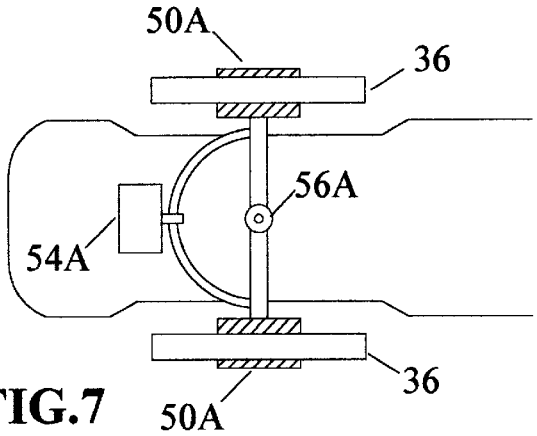
FIG. 7 illustrates an alternate steering technique.

Although the steering mechanism depicted in FIG. 6 is a typical automotive type, any suitable technology may be used. For example, FIG. 7 shows a simple wagon style in which two primary wheels 36 pivot about a common vertical axis pivot 56A. The implementation shown includes electric motors 50A in the hubs of the wheels. These motors provide motive power and also assist with steering via differential speed control. Due to the hub motors, steering actuator 54A shown in FIG. 7 is not strictly needed—differential speed control could perform the same function—but the actuator provides redundancy and additional stability.

Proximity sensors 58 as shown in FIG. 6 measure the distance between motive unit 26 and guideway 24. Any suitable technology may be used. Examples include ultrasonic, inductive, capacitive, and optical triangulation sensors. The distances involved, typically a few inches, is beyond the maximum range of the most common off-the-shelf capacitive or inductive sensors but is within the minimum range of ultrasonic sensors, especially if they are recessed within the body of motive unit 26. An example of a suitable sensor is the Honeywell 942-A4N-2D-1C1-300E.

Rather than (or in addition to) measuring the distance between motive unit 26 and the vertical side walls of guideway 24 (or a reference strip), power conductor 34 and the interior edges of primary traction surfaces 30 may also serve as references for position measurement. For example, power conductor 34 can be tracked optically using a lens to focus an image of the power conductor onto a linear photodiode (or CCD) array. By illuminating the conductor with a line source at an angle different from that of the sensor, a high contrast image will be obtained without interference from the more distant undersurface of the guideway. More specifically, a fan shaped illumination beam and a fan shaped camera look-angle are situated such that they intersect in a lateral horizontal line positioned at the underside of power conductor 34.

Payload unit 28 is suspended below motive unit 26 by a payload support flange 60 and hinge 62. As best seen in FIG. 3, payload support flange 60 is narrow at the horizontal plane defined by the bottom of primary wheels 36. This width must be smaller than the width of primary wheels 36 because, as will be detailed later, the wheels must roll over a slot through which payload support flange 60 can pass. Motive unit 26 typically contains a number of electronic parts that must make connection with parts mounted on or in payload unit 28. For example, radar, optic and ultrasonic sensors along with radio antennas may be affixed to the payload unit. Such power and communication/control cables can be routed to payload unit 28 through payload support flange 60. This arrangement protects the cables from bird strikes and other environmental factors.

Hinge 62 allows payload unit 28 to swing laterally about a horizontal axis. This allows guideway 24 and motive unit 26 to be laterally narrow and yet never tip under conditions of side wind or cornering forces. To avoid prolonged oscillatory movement of the payload after a turn or after a wind gust, a damping unit 64 is attached to hinge 62. Although conventional technology may be used for damping, it is advantageous to use a DC gear motor in this application. This not only allows the damping factor to be adjusted as needed but also allows the hinge to be actively driven. Applying force to the hinge allows for precise positioning of the payload when coming to a stop at a station. It also allows the control computer to create a torque that reduces or eliminates wheel loading on one side of motive unit 26 in order to provide a smoother ride through diverge/merge sections. As will be described later, when motive units pass through Y-shaped diverge/merge sections, the inside pair of wheels must ride over a slot and transition from support by one guideway to support by another.

Figure 8:
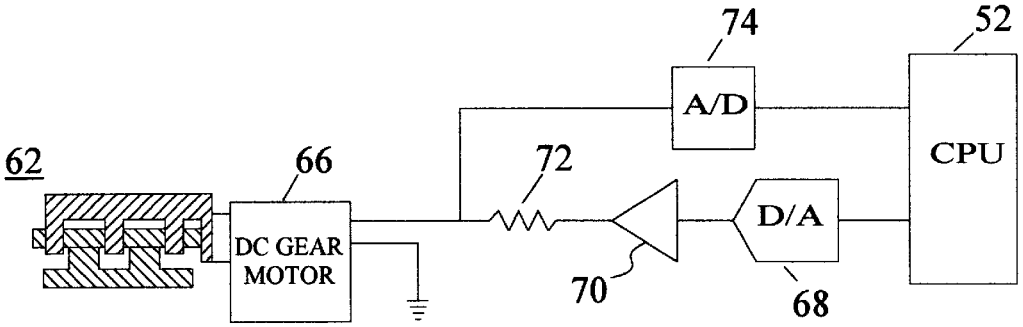
FIG. 8 is a block diagram of a powered hinge.

A block diagram of a computer controlled motorized hinge is shown in FIG. 8. In such a motorized hinge, the shaft of the DC gear motor 66 is aligned to the axis of rotation of hinge 62 with the shaft affixed to one side of the hinge while the frame of the motor is affixed to the other side. The gear ratio and motor power are chosen such that hinge 62 swings freely enough to not tip motive unit 26 when the motor is open-circuited but will tip it when the motor is short-circuited.

DC gear motor 66 is computer controlled using a digital to analog converter 68 feeding the input of a power amplifier 70 whose output passes through a resistor 72 into the motor. The voltage across the motor is monitored by an analog to digital converter 74. A variable damping factor may be obtained by driving power amplifier 70 with a fraction of the measured motor voltage. If the fraction is unity, the voltage across resistor 72 is zero and the motor operates in open-circuit mode and the damping is minimal. If the fraction is zero, then the full motor voltage is applied across the resistor and damping is maximal. To actively drive the motor with a specific torque, the power amplifier is driven with a voltage adjusted to maintain a specific voltage (and thus current) across resistor 72. Finally, a shaft encoder (not shown) may be attached to the motor to provide angle information to the computer that can then use the motor to drive the payload to a specific angle. As those skilled in the art will best understand, other electro-mechanical and electronic control means may be employed.

Alternate Guideway Channel Configurations

Figure 9A:
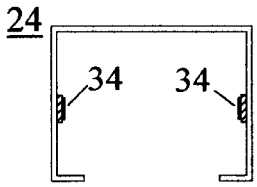
FIG. 9A is a cross section of an alternate channel with power conductors on the side walls.
Figure 10:
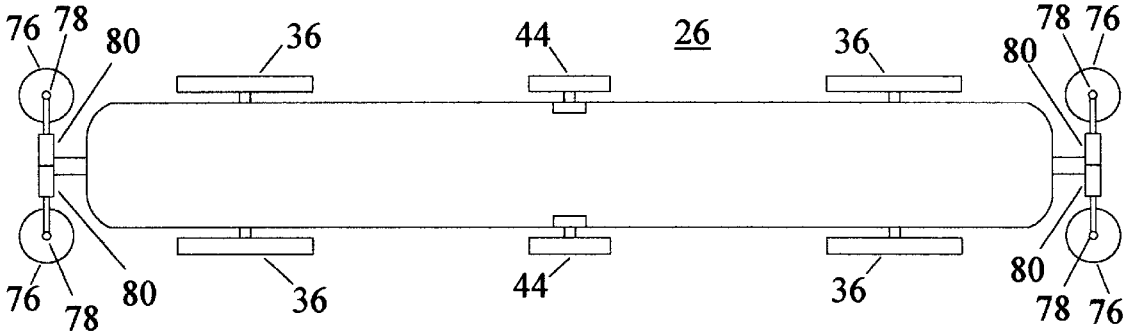
FIG. 10 is a plan view of a motive unit corresponding to FIG. 9A.

The guideway channel and motive unit configuration shown in FIG. 2 and FIG. 3 is only one of many possibilities that may be suitable depending on the application. For example, FIG. 9A shows a guideway channel configuration in which power conductor 34 has been placed along the vertical sidewalls of the channel. The corresponding vehicle configuration is shown in FIG. 10 (top view). The lateral guide wheels 76 rotate about a vertical axis 78 and can be extended laterally using actuator 80. Guide wheel actuator 80 can be as simple as a spring. Lateral guide wheels 76 can act not only as power pickups but can also act, by measuring the extension of actuator 80, as lateral position sensors for the motive unit and additionally can act as emergency spacers to prevent the main wheels from contacting the side channel in the event of loss of control. In this configuration, either primary wheels 36 or stabilizing wheels 44 can act as the power return conductor. Lateral guide wheels 76 may be useful as emergency spacers even in configurations where they are not used for electrical pickups or sensors.

Figure 9B:
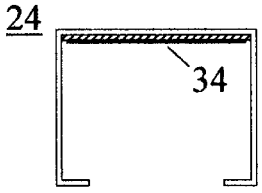
FIG. 9B is a cross section of an alternate channel with the power conductor on the top surface.
Figure 9C:
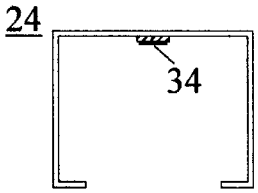
FIG. 9C is a cross section of an alternate channel with a power conductor strip on the top surface.

FIG. 9B shows a channel configuration in which the underside of the top surface of the channel acts as power conductor 34. In this configuration, the auxiliary wheels could act as power pickups. FIG. 9C shows a channel configuration with a power conductor strip in the center of the channel. This configuration is similar to that shown in FIG. 2 except this time the power conductor is not located above the running surface for the auxiliary wheels. In a diverge/merge section, the inside auxiliary wheel may be retracted or the power conductor may be recessed into the top of the channel or the power strip may be deleted altogether. In the latter case, the vehicle may simply coast through the unpowered section or an auxiliary power source (e.g., an electromechanical battery) can provide momentary power. Alternately, the motive unit may utilize one or more stabilizing wheels 44 located along its centerline to act as power pickups for the power strip shown in FIG. 9C.

Guideway Topology

A very important part of the invention is the ability of individual vehicles on the guideway to exit to or merge from a secondary guideway at full speed and with close spacing between vehicles. Under nominal conditions, no additional contact is needed between vehicles and the track surfaces beyond that already discussed with regard to wheels and power pickups.

Figure 11:
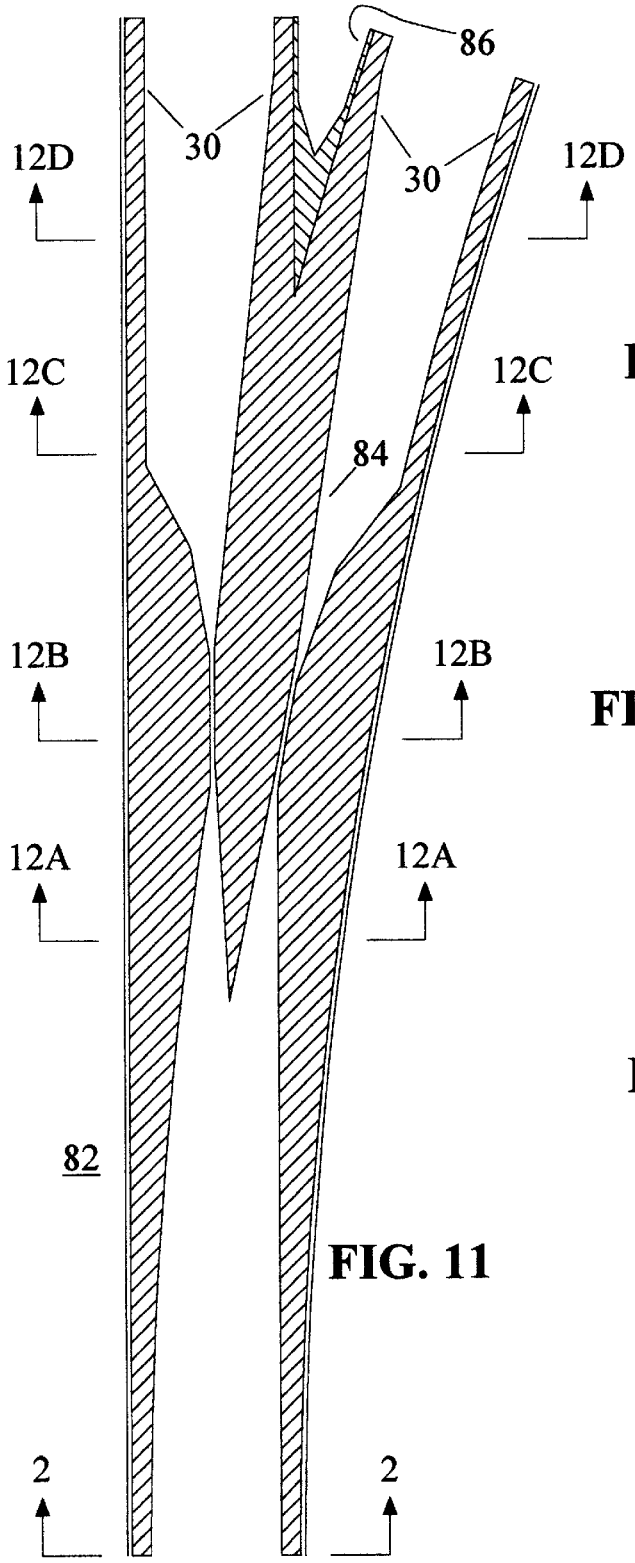
FIG. 11 shows a floor plan of diverge/merge section.
Figure 12D:
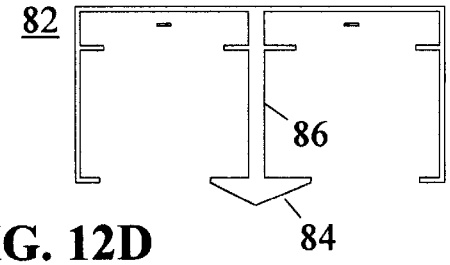
FIG. 12D is a cross section of a diverge/merge section taken along line 12D—12D.
Figure 12C:
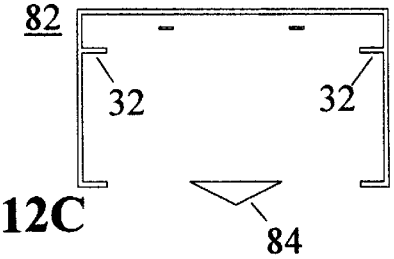
FIG. 12C is a cross section of a diverge/merge section taken along line 12C—12C.
Figure 12B:
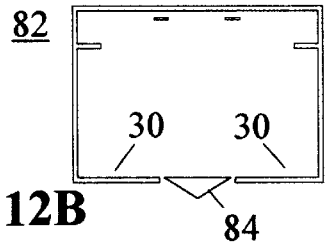
FIG. 12B is a cross section of a diverge/merge section taken along line 12B—12B.
Figure 12A:
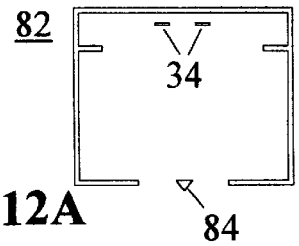
FIG. 12A is a cross section of a diverge/merge section taken along line 12A—12A.

The base or floor plan of primary traction surfaces 30 for a diverge/merge section 82 is shown FIG. 11 while channel cross sections at the indicated cut lines are shown in FIG. 2 and FIGS. 12A–12D. Diverge/merge section 82 bifurcates a main guideway channel at the bottom of FIG. 11 into two branch guideway channels at the top. The interior branching guideway is completely passive and motive unit 26 simply hugs either the left or the right wall while traveling through the section. If vehicle flow is in a horizontal longitudinal direction from the bottom of FIG. 11 toward the top then the section is a diverge or exit section which can split one vehicle stream into two. The reverse direction allows two streams of vehicles to merge into one. In the center portion of diverge/merge section 82, primary traction surfaces 30 are extended inward to form narrow slots through which payload flange 60 passes. Primary wheels 36 are wide enough to ride over the slot. The slot needs to be narrow only at the two locations where the wheel track and flange paths intersect.

The area where the two track sections meet form a central wedge 84. The central pair of traction surfaces must be supported by the thick central wall 86 which in turn must be supported from above the guideway channel or by extra thickness of the top surface of the section. Because central wedge 84 extends quite a distance from the vertical support provided by central wall 86, it might be desirable to reduce loading on this section. This could be accomplished by using the motorized hinge shown in FIG. 2 and FIG. 3 to momentarily provide a torque that removes load from the inside wheels just as the unit passes through the critical area. A vehicle taking the curved branch in FIG. 11 will experience a centrifugal force that, were it not for hinge 62, would cause motive unit 26 to tip with the inside wheels lifting off the track. Therefore, by adjusting the stiffness of damper 64, the downward force on the inside wheels can be reduced or eliminated as desired. If both branches of a Y-shaped diverge/merge section were curved, then inner wheel unloading could be accomplished using a passive (non-motorized) hinge damper.

Another way to unload the inner pair of primary wheels 36 is to create a torque using the outside stabilizing wheel 44. If stabilizing wheels 44 are laterally positioned outside the track of primary wheels 36, then force applied by an auxiliary wheel actuator 46 will create a torque that will act to lift the opposite side. One can either adjust the actuator force as the motive unit passes through the diverge/merge section or the section can be built with secondary traction surfaces 32 slightly lower. The latter method has the advantage of being automatic and not requiring sudden changes in the actuator force. If this method proves to be reliable, it may be possible to remove the wedge extension and let the inner pair of primary wheels 36 ride completely unsupported over a large gap in a diverge/merge section.

The length of diverge/merge section 82 depends on the design speed. A speed of 100 MPH will require a length on the order of 100 feet given a track width of three feet and an allowable lateral acceleration of 0.2 g. A speed of 50 MPH requires about 50 feet.

The entire track network can be formed from straight or curving sections and from diverge/merge sections. This is similar to our current freeway system and layouts for exits, entrances and junctions for the present invention can be derived from current practice.

Locations on the network where personal vehicles or passengers enter or exit the system require special attention. There are two basic topologies for loading/unloading autos from a carrier. In the first topology, carrier vehicles simply come to a stop and allow autos to drive off and new autos to drive on after which the carriers continue along the track section. In the second topology, carrier vehicles take a branch off of a feeder line and stop at a stall where autos drive off and/or on. The carriers then back out of the stall and eventually merge back onto a feeder line. A tree of Y-branches can be used to split a high-speed track into a number of slow-speed parallel feeder lines in a boarding area. An inverse tree of Y-branches allows the traffic to merge and accelerate to full track speed.

Traffic control in an entrance/exit area could be either autonomous or could be directed by a computer dedicated to the area. If autonomous control is desired, each vehicle will need to know the topology of the area and will need to know the positions of other vehicles in the area (or at least will need to know if any empty unloading stations are available).

Tracks can be supported by structures similar to those used for bridges and highway overpasses. However, it should be noted that the weight of the track as compared to the dynamic load of vehicles is much lower than that for bridges and overpasses. Consequently, support structures will need to be stiffer and more closely spaced than the latter. The high speed of vehicles along the track makes the need for proper support even more important. For example, if, due to track irregularities or to dynamic flexing due to the vehicles themselves, there is a 1 inch vertical undulation every 100 feet, then vehicles traveling at 130 MPH will experience a 0.2 g, 2 Hz vertical vibration. Depending on the application, it may be preferable to insert a suspension mechanism between hinge 62 and the rest of the payload in order to relax the requirements on guideway construction.

Track sections can be joined and supported by sleeves. Within a sleeve, track sections are butted together using an interdigitated thermal expansion joint. One section of track can be firmly affixed to the sleeve while the other can be free to move slightly in the direction of travel to eliminate thermal stress and to allow for the very slight motion as a track section sags and rebounds from the dynamic load of vehicles traveling along a section.

Steering

Vehicles drive along the guideway and though exit/merge sections just like cars on a freeway. Just as human drivers in cars adjust the steering to maintain their vehicles in their traffic lane or to steer onto an exit ramp, the present invention uses electronically controlled steering under the control of the vehicle's computer to keep the motive unit centered in the guideway or along the proper path in exit/merge sections.

Steering control is performed using information provided by proximity sensors 58 as previously described. It is important to note that because motive unit 26 can know its lateral position in guideway 24 with arbitrarily great precision, the control laws for steering and acceleration/breaking can be much simpler and more precise than their counterparts in systems such as the National Automated Highway System. Optionally, the unit can know the exact curvature of the guideway by reading marks on or near the guideway in analogy to conventional road signs. The steering control system can use the lateral position information along with the guideway curvature to calculate a proper steering angle for the wheels.

Figure 13:
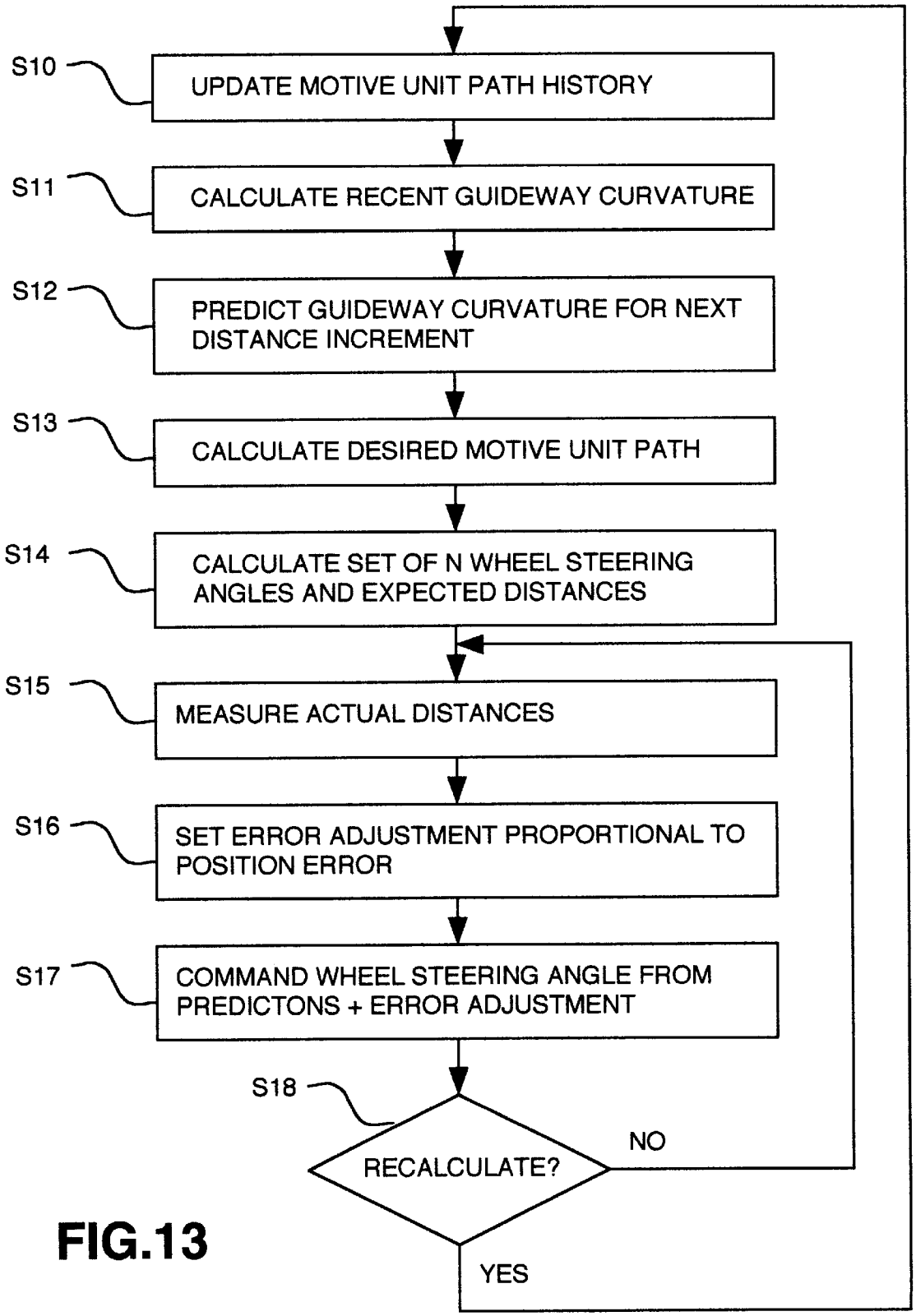
FIG. 13 is a flow chart for steering control.

The flow chart in FIG. 13 illustrates the technique of using a proportional control servo loop to add fine adjustment on top of a nominal steering angle. The following description is based on the motive unit configuration illustrated in FIG. 6 and further assumes that the motive unit is traveling through main guideway 24. When traveling through diverge/merge section 82 only the left or right proximity sensors would be used.

At step S10, the recent motive unit path in the horizontal plane is calculated by integrating the model response of the motive unit to the recent history of wheel steering angles and speeds. The result is a set of [x,y] positions calculated at each proximity sensor 58. This set is fed into step S11 where the measured distances from each sensor to the sidewall of guideway 24 are added to the calculated sensor position to create sets of sidewall locations for the left and right sidewalls. In step S12 the known sidewall locations are extrapolated a short distance (one or two motive unit lengths) using a curve fit to a smoothing spline or any other appropriate function. Step S13 calculates the desired path for motive unit 26 based on its last location, wheel steering angles and speed combined with the extrapolated guideway curvature. In step S14, the desired path is subdivided into an array of N points based on the distance, speed and on the sampling rate of the following servo loop. For example, if the distance being extrapolated is 15 feet, the speed is 150 fps and the following servo loop sample rate is 100 Hz, then an array of N=10 points is generated. For each of the N points, a steering angle is calculated to effect the desired path and a predicted distance from each sensor to the sidewall is calculated.

The array of N steering angles and predicted distances is then sent to the servo loop starting at step S15. The servo loop implements a proportional steering control added to the nominal angles just calculated. In step S15, the actual distances between each proximity sensor 58 to the sidewall of guideway 24 are measured and stored. Step S16 uses the difference between the measured and predicted sensor distance values to calculate a steering error adjustment proportional to the measured distance error. In Step S17, steering actuator 54 is then commanded to slew to a steering angle calculated as the sum of the angle from the current array member and the error adjustment. The servo loop branches at step S18 back to step S15 unless the data is exhausted or the error adjustment exceeds a preset limit in which case an array of actual steering angle and measured proximity sensor distances is sent back to step S10 where the process continues.

Those skilled in the art will understand that a wide variety of steering control techniques may be used.

High side winds impinging on the payload unit may cause the motive unit to slip sideways in the guideway. This slippage can be detected by the computer when the steering control tries to apply too much steering correction for the current conditions of speed and track curvature. The computer can then command the auxiliary wheels to be forced into contact with the auxiliary track or command that the force exerted be increased in order to increase the available traction.

Operation

Motive units determine their position along the guideway network using sensors to read marks associated with the guideway channel. GPS can also be used but is problematic in cities, tunnels and inside buildings. Motive units learn they are near exits by communication with exit controllers and/or by use of an electronically stored and/or transmitted map.

Each vehicle can be operated either autonomously or under the control of an external computer system or any combination of the two. In autonomous mode, the vehicle navigates to its destination just as a human driver would. The vehicle's computer tracks the position, speed and status of other vehicles in the immediate vicinity as reported via radio links. Each vehicle broadcasts its information in short bursts several times per second on a semirandom or preprogrammed basis and redundantly on several different radio channels. The information broadcast can contain not only the vehicle's own status but also a summary of information gleaned from other vehicles. If status reports from a given vehicle suddenly stop then those vehicles behind can declare an emergency and come to an immediate stop while sending out a distress signal. Radar units may be used to provide redundant position/speed information about vehicles immediately in front and behind and can be used to detect foreign objects. Radar units may be mounted on the motive unit, payload or both. Radar units mounted on the motive unit directed along the guideway may be able to take advantage of the whispering gallery effect to detect objects around curves.

Under nominal conditions, vehicles travel at the speed appropriate for the current location. The designated speed can be obtained from a stored electronic map updated with information from trackside or regional radio broadcasts. To reduce energy use, vehicles can travel in close spaced formation as long as conditions allow.

In semi-autonomous mode, vehicles are directed by local 'traffic cop' control units positioned at exit/merge junctions, passenger load/unload stations and other locations that would benefit from local supervision. When not being directed by a 'traffic cop', vehicles operate autonomously. In full global mode, each vehicle is externally tracked and directed by a command center. Full global is efficient for small systems but becomes increasingly unwieldy as the system becomes more and more interconnected.

Passenger interaction with the system can take on many forms most of which are analogous to methods used with today's tollways, taxies, buses and subway systems. For example, a tollway that transports passengers in their own vehicles from point A to/from point B my need nothing more than a toll collection system and perhaps a button the user can press to let the system know they have properly parked their vehicle on a transport platform. Systems that carry individuals in taxi like payload units can operate like a combination of taxies and subways. Passengers could enter their desired destination on a map, receive a magnetic encoded ticket (or have their own personal smart card updated) and enter the next available vehicle. For vehicle carrying systems that have complex branching, it may be desirable for the driver to interact with the system while in transit. This can be accomplished initially using small hand held units picked up when entering the system and dropped off when exiting or by use of controllers built into the payload module. Later, people may own their own hand-held controller modules or controllers may be built into the user's vehicle in a manner similar to GPS navigation options available in some luxury cars at the time of this writing.

Although the invention has been described in terms of a transportation system to augment our current roadway system, it can also be used for other transportation purposes. For example, a smaller scale system could be used as part of an automatic baggage handing system at an airport. Such a system could transport individual baggage items directly from the baggage hold of an airplane to their owner at any of a number of locations on the airport grounds. The owner would have only to punch in an ID number or insert an ID card into a kiosk to get their baggage delivered directly to that location. The payload section could be designed to unlock only for the owner. Baggage kiosks could be located throughout the parking lot, at bus stops, rental car locations or at passenger stations for the transportation system of the present invention.

Other applications include, but are not limited to, factory automation, theme park transportation, thrill rides, ski lifts, river or canyon ferries and toys.

While the forgoing specification has described preferred embodiments of the present invention, one skilled in the art may make many modifications to the preferred embodiment without departing from the invention in its broader aspects. The appended claims therefore are intended to cover all such modifications as they fall within the true scope and spirit of the invention.

I claim:

1. An overhead transportation system for carrying a payload comprising:

a motive unit comprising a chassis and a first primary wheel mounted on said chassis for rotating about a horizontal first axis and for pivoting about a vertical second axis;

a guideway defining an elongate channel extending in a horizontal longitudinal direction providing a pathway for said motive unit, said guideway comprising an elongate horizontal, upward-facing first primary traction surface extending in said longitudinal direction for supporting said first primary wheel of said motive unit, wherein said motive unit moves within said channel in a direction determined by an angular position of said first primary wheel about said second axis;

sensing means for measuring a lateral position of said motive unit within said channel in a horizontal lateral direction perpendicular to said longitudinal direction and for generating an electronic control signal indicating said lateral position; and steering means for adjusting said angular position of said first primary wheel about said second axis to adjust said lateral position in response to said electronic control signal to guide said motive unit along a predetermined path.

2. The overhead transportation system in accordance with claim 1 wherein said guideway further comprises an elongate, downward-facing horizontal first secondary traction surface vertically offset from said first primary traction surface, and wherein said motive unit further comprises a first stabilizing wheel mounted on said chassis for rotating about a third axis parallel to said first axis and for contacting said first secondary traction surface.

3. The overhead transportation system in accordance with claim 2 wherein said first primary and first stabilizing wheels are horizontally offset.

4. The overhead transportation system in accordance with claim 2 wherein said guideway comprises:

an elongate first wall extending in said longitudinal direction;

an elongate first flange attached to said first wall, extending in said longitudinal direction and having an upper surface providing said first primary traction surface; and an elongate second flange attached to said first wall, vertically displaced from said first flange, extending in said longitudinal direction and having a lower surface providing said first secondary traction surface.

5. The overhead transportation system in accordance with claim 1 wherein said guideway further comprises an elongate, downward-facing horizontal first secondary traction surface, and wherein said motive unit further comprises a first stabilizing wheel mounted on said chassis for rotating about a second axis parallel to said first axis and means for selectively adjusting a vertical position of said first stabilizing wheel relative to said first primary traction surfaces so as to selectively bring said first stabilizing wheel into contact with said first secondary traction surface.

6. The overhead transportation system in accordance with claim 5 wherein said first primary and first stabilizing wheels are horizontally offset.

7. The overhead transportation system in accordance with claim 1 wherein said guideway comprises:

an elongate first wall extending in said longitudinal direction; and an elongate first flange attached to said first wall, extending in said longitudinal direction and having an upper surface providing said first primary traction surface.

8. The overhead transportation system in accordance with claim 1 wherein said motive unit further comprises means for rotating said first primary wheel about said first axis thereby to move said motive unit through said channel in said direction determined by said angular position of said first primary wheel about said second axis.

9. The overhead transportation system in accordance with claim 1 further comprising second means for suspending said payload from said chassis such that said payload is held below said guideway.

10. The overhead transportation system in accordance with claim 9 wherein said second means comprises:

holding means for holding said payload; and a hinge attaching said holding means to said chassis such that said holding means is suspended below said chassis, said hinge permitting said holding means to rotate about a horizontal axis of rotation.

11. The overhead transportation system in accordance with claim 1 wherein said transportation system further comprises:

holding means for holding said payload, a hinge having a horizontal axis of rotation for suspending said holding means from said motive means, and means for applying a force to said hinge causing it to rotate about said horizontal axis of rotation.

12. The overhead transportation system in accordance with claim 1 wherein said guideway includes a conductor extending in said longitudinal direction for conducting electricity, and wherein said motive unit includes an electric motor for providing motive force for moving said motive unit through said channel and means for contacting said conductor as said motive unit moves though said channel and for delivering said electricity to said electric motor.

13. The transportation system in accordance with claim 1 wherein said first primary wheel comprises:

a first subwheel assembly mounted for rotation about said first axis, and a second subwheel assembly mounted for rotation about said first axis horizontally spaced from said first subwheel assembly.

14. The transportation system in accordance with claim 1 wherein said sensing means comprises:

a guide wheel; and means mounting said guide wheel on said chassis for rotation about a vertical axis and adjustably extending said guide wheel in said lateral direction for sensing said lateral position.

15. The transportation system in accordance with claim 1 wherein said motive unit further comprises a guide wheel mounted on said chassis for rotation about a vertical axis and extending beyond said chassis in said lateral direction.

16. The transportation system in accordance with claim 1 wherein said motive unit further comprises first and second guide wheels mounted on said chassis for rotation about vertical axes, said first and second guide wheels extending beyond said chassis in opposing lateral directions.

17. An overhead transportation system for carrying a payload comprising:

a motive unit comprising a chassis and a first primary wheel mounted on said chassis for rotating about a horizontal first axis and for pivoting about a vertical second axis;

a guideway defining an elongate channel extending in a horizontal longitudinal direction providing a pathway for said motive unit, said guideway comprising an elongate horizontal, upward-facing first primary traction surface extending in said longitudinal direction for supporting said first primary wheel of said motive unit, wherein said motive unit moves within said channel in a direction determined by an angular position of said first primary wheel about said second axis;

first means for sensing a lateral position of said motive unit within said channel in a horizontal lateral direction perpendicular to said longitudinal direction and for adjusting said angular position of said first primary wheel about said second axis to adjust said lateral position, wherein said motive unit further comprises a second primary wheel mounted on said chassis for rotating about said first axis and for pivoting about a third axis parallel to said second axis, wherein said guideway further comprises an elongate horizontal, upward-facing second primary traction surface extending in said longitudinal direction horizontally displaced from said first primary traction surface for supporting said second primary wheel of said motive unit, and wherein said first means also adjusts an angular position of said second primary wheel about said third axis.

18. The overhead transportation system in accordance with claim 17 wherein said guideway further comprises an elongate, downward-facing horizontal first secondary traction surface vertically offset from said first primary traction surface, and an elongate, downward-facing horizontal second secondary traction surface vertically offset from said second primary traction surface, and wherein said motive unit further comprises a first stabilizing wheel mounted on said chassis for rotating about a second axis parallel to said first axis and contacting said first secondary traction surface and a second stabilizing wheel mounted on said chassis for rotating about said second axis and contacting said second secondary traction surface.

19. The overhead transportation system in accordance with claim 18 wherein said guideway comprises:

an elongate first wall extending in said longitudinal direction;

an elongate first flange attached to said first wall, extending in said longitudinal direction and having an upper surface providing said first primary traction surface;

an elongate second flange attached to said first wall, vertically displaced from said first flange, extending in said longitudinal direction and having a lower surface providing said first secondary traction surface;

an elongate third flange attached to said second wall, extending in said longitudinal direction and having an upper surface providing said second primary traction surface; and an elongate fourth flange attached to said second wall, vertically displaced from said third flange, extending in said longitudinal direction and having a lower surface providing said second secondary traction surface.

20. The overhead transportation system in accordance with claim 17 wherein said motive unit further comprises means mounted on said chassis for rotating said first and second primary wheels about said first axis thereby to move said motive unit through said channel.

21. The overhead transportation system in accordance with claim 17 wherein said guideway comprises:

elongate first and second walls extending in said longitudinal direction, an elongate first flange attached to said first wall, extending in said longitudinal direction and having an upper surface providing said first primary traction surface, and an elongate second flange attached to said second wall, extending in said second direction and having an upper surface providing said second primary traction surface.

22. The overhead transportation system in accordance with claim 17 further comprising:

holding means for holding said payload; and a hinge for attaching said holding means to said chassis substantially midway between said first and second primary wheels, said hinge permitting said holding means to rotate about a horizontal axis of rotation.

23. The overhead transportation system in accordance with claim 22 further comprising damping means for substantially damping rotation of said holding means about said horizontal axis of rotation.

24. An overhead transportation system for carrying a payload comprising:

a motive unit comprising a chassis and a first primary wheel mounted on said chassis for rotating about a horizontal first axis and for pivoting about a vertical second axis;

a guideway defining an elongate channel extending in a horizontal longitudinal direction providing a pathway for said motive unit, said guideway comprising an elongate horizontal, upward-facing first primary traction surface extending in said longitudinal direction for supporting said first primary wheel of said motive unit, wherein said motive unit moves within said channel in a direction determined by an angular position of said first primary wheel about said second axis;

first means for sensing a lateral position of said motive unit within said channel in a horizontal lateral direction perpendicular to said longitudinal direction and for adjusting said angular position of said first primary wheel about said second axis to adjust said lateral position, wherein said primary traction surface conducts electricity, wherein said first primary wheel conducts electricity from said primary traction surface, wherein said motive unit includes an electric motor for providing motive force for moving said motive unit through said channel, and wherein said motive unit includes means for conducting electricity between said electric motor and said first primary wheel, thereby to provide electric power to said electric motor.

25. An overhead transportation system for carrying a payload comprising:

a motive unit comprising a chassis and a first primary wheel mounted on said chassis for rotating about a horizontal first axis and for pivoting about a vertical second axis;

a guideway defining an elongate channel extending in a horizontal longitudinal direction providing a pathway for said motive unit, said guideway comprising an elongate horizontal, upward-facing first primary traction surface extending in said longitudinal direction for supporting said first primary wheel of said motive unit, wherein said motive unit moves within said channel in a direction determined by an angular position of said first primary wheel about said second axis;

first means for sensing a lateral position of said motive unit within said channel in a horizontal lateral direction perpendicular to said longitudinal direction and for adjusting said angular position of said first primary wheel about said second axis to adjust said lateral position, wherein said guideway further comprises an elongate, downward-facing horizontal first secondary traction surface vertically offset from said first primary traction surface, wherein said motive unit further comprises a first stabilizing wheel mounted on said chassis for rotating about a third axis parallel to said first axis and for contacting said first secondary traction surface, wherein said secondary traction surface conducts electricity, wherein said first stabilizing wheel conducts electricity from said secondary traction surface, wherein said motive unit includes an electric motor for providing motive force for moving said motive unit through said channel, and wherein said motive unit includes means for conducting electricity between said electric motor and said first stabling wheel, thereby to provide electric power to said electric motor.

26. An overhead transportation system for carrying a payload comprising:

a motive unit comprising a chassis and a first primary wheel mounted on said chassis for rotating about a horizontal first axis and for pivoting about a vertical second axis;

a guideway defining an elongate channel extending in a horizontal longitudinal direction providing a pathway for said motive unit, said guideway comprising an elongate horizontal, upward-facing first primary traction surface extending in said longitudinal direction for supporting said first primary wheel of said motive unit, wherein said motive unit moves within said channel in a direction determined by an angular position of said first primary wheel about said second axis;

first means for sensing a lateral position of said motive unit within said channel in a horizontal lateral direction perpendicular to said longitudinal direction and for adjusting said angular position of said first primary wheel about said second axis to adjust said lateral position, wherein said motive unit further comprises a guide wheel mounted on said chassis for rotation about a vertical axis and extending beyond said chassis in said lateral direction, wherein said guideway includes a conductor extending in said longitudinal direction for conducting electricity, the first guide wheel contacting said conductor and conducting said electricity from said conductor when said motive unit moves though said channel, and wherein said motive unit includes an electric motor for providing motive force for moving said motive unit through said channel and means linked to said electric motor for contacting said first guide wheel and conducting said electricity to said electric motor.

27. An overhead transportation system for carrying a payload comprising:

a motive unit comprising a chassis, a first primary wheel mounted on said chassis for rotating about a horizontal first axis and for pivoting about a vertical second axis, and a second primary wheel mounted on said chassis for rotating about said horizontal first axis and for pivoting about a vertical third axis;

a main guideway defining an elongate main channel extending in a horizontal longitudinal direction providing a pathway for said motive unit, said guideway comprising an elongate horizontal, upward-facing first and second primary traction surfaces extending in said longitudinal direction for respectively supporting said first and second primary wheels of said motive unit, wherein said motive unit moves within said main channel in a direction determined by angular positions of said first and second primary wheels about said second and third axes, respectively;

a first branch guideway substantially similar to said main guideway defining a first branch channel substantially similar to said main channel;

a second branch guideway substantially similar to said main guideway defining a second branch channel substantially similar to said main channel;

a branching guideway for interconnecting said main guideway to said first and second branch guideways, said branching guideway defining a branching channel for conveying said motive unit from said main channel selectively to one of said first and second branch channels as determined by said angular positions of said first and second primary wheels about said second and third axes, respectively;

sensing means for measuring a lateral position of said motive unit within said main channel and within said branching channel and within said first and second branch channels in a horizontal lateral direction perpendicular to said longitudinal direction and for generating an electronic control signal indicating said lateral position; and steering means for adjusting said angular position of said first and second primary wheels about said second and third axes, respectively, in response to said electronic control signal to guide said motive unit along a predetermined path.

28. The overhead transportation system in accordance with claim 27 further comprising:

holding means for holding said payload; and a hinge attaching said holding means to said flange such that said holding means is suspended below said guideway, said hinge permitting said holding means to rotate about a horizontal axis of rotation.

29. The overhead transportation system in accordance with claim 28 further comprising damping means for substantially damping rotation of said holding means about said horizontal axis of rotation.

30. An overhead transportation system for carrying a payload comprising:

a motive unit comprising a chassis, a first primary wheel mounted on said chassis for rotating about a horizontal first axis and for pivoting about a vertical second axis, and a second primary wheel mounted on said chassis for rotating about said horizontal first axis and for pivoting about a vertical third axis;

a main guideway defining an elongate main channel extending in a horizontal longitudinal direction providing a pathway for said motive unit, said guideway comprising an elongate horizontal, upward-facing first and second primary traction surfaces extending in said longitudinal direction for respectively supporting said first and second primary wheels of said motive unit, wherein said motive unit moves within said main channel in a direction determined by angular positions of said first and second primary wheels about said second and third axes, respectively;

a first branch guideway substantially similar to said main guideway defining a first branch channel substantially similar to said main channel;

a second branch guideway substantially similar to said main guideway defining a second branch channel substantially similar to said main channel;

a branching guideway for interconnecting said main guideway to said first and second branch guideways, said branching guideway defining a branching channel for conveying said motive unit from said main channel selectively to one of said first and second branch channels as determined by said angular positions of said first and second primary wheels about said second and third axes, respectively;

means for sensing a lateral position of said motive unit within said main channel and within said branching channel and within said first and second branch channels in a horizontal lateral direction perpendicular to said longitudinal direction and for adjusting said angular position of said first and second primary wheels about said second and third axes, respectively, to adjust said lateral position, wherein said motive unit further comprises a flange attached to and extending downward from said chassis, and wherein said branching guideway comprises a base having an upward facing surface for supporting said first and second primary wheels when said branching channel conveys said motive unit, said base including a branching slot for receiving said flange and for providing a branching pathway for said flange when said branching channel conveys said motive unit.

31. The overhead transportation system in accordance with claim 30 further comprising second means for suspending said payload from said flange such that said payload is held below said guideway.

* * * * *